US008726470B2

(12) United States Patent
Hoffman

(10) Patent No.: US 8,726,470 B2
(45) Date of Patent: May 20, 2014

(54) CLOTHING FASTENING SYSTEM

(71) Applicant: Ervin Hoffman, Brooklyn, NY (US)

(72) Inventor: Ervin Hoffman, Brooklyn, NY (US)

( * ) Notice: Subject to any disclaimer, the term of this patent is extended or adjusted under 35 U.S.C. 154(b) by 0 days.

(21) Appl. No.: 13/664,396

(22) Filed: Oct. 30, 2012

(65) Prior Publication Data

US 2013/0291340 A1 Nov. 7, 2013

Related U.S. Application Data

(60) Provisional application No. 61/553,227, filed on Oct. 30, 2011.

(51) Int. Cl.
*A44B 1/08* (2006.01)
*A44B 1/18* (2006.01)

(52) U.S. Cl.
USPC ..... 24/114.4; 24/306; 24/90.1; 24/379.1

(58) Field of Classification Search
USPC ..... 24/114.4, 306, 40, 90.1, 114, 379.1; 2/912, 920
See application file for complete search history.

(56) References Cited

U.S. PATENT DOCUMENTS 2,028,423 A * 1/1936 Upham ..... 292/307 R
4,648,137 A * 3/1987 Cooper ..... 2/116
4,939,794 A * 7/1990 Aronson ..... 2/128
5,048,160 A * 9/1991 Goodrich et al. ..... 24/306
6,260,243 B1 * 7/2001 Fildan et al. ..... 24/329
6,430,786 B1 * 8/2002 Ikeda et al. ..... 24/444
2005/0251970 A1 * 11/2005 Fildan et al. ..... 24/114.05
2007/0006430 A1 * 1/2007 Issler ..... 24/591.1
2009/0211060 A1 * 8/2009 Jones et al. ..... 24/114.4

* cited by examiner

*Primary Examiner* — Robert J Sandy
*Assistant Examiner* — Matthew Sullivan
(74) *Attorney, Agent, or Firm* — Israel Nissenbaum; Yitzy Nissenbaum

(57) ABSTRACT

A fastening system for fastening garment elements, with the garment comprising a button closure comprised of a button and a buttonhole. The fastening system is comprised of two fastening members, each of which has a base element. A base element of a first member is integrated with hook elements of a hook and eye fastener and the base element of the second member is integrated with eye elements of the hook and eye fastener. A fastener button is fixedly attached to a side of a base element of one of the two members, on a side obverse to the integrated hooks or eyes thereon. The other of the two members comprises an engaging fastener aperture, which extends through the base element and the integrated hooks or eyes thereon. The engaging fastener aperture permit the garment button to pass therethrough, effecting a holding engagement between the member and a garment element.

5 Claims, 1 Drawing Sheet

CLOTHING FASTENING SYSTEM

FIELD OF THE INVENTION

Figure 1A:
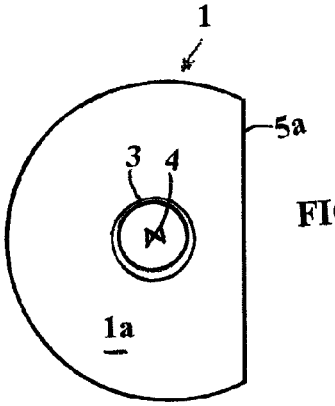

This invention relates to a fastening system for clothing such as shirts having buttons and button holes and relates particularly to a removable fastener system suitable for individuals having difficulty with fastening button closures.

BACKGROUND

Quick release fastening systems, requiring little or no manual dexterity and which effect fastening with a simple contact touch, are known. These usually involve separate elements of hooks and eyes which link together, upon contact, to become fastened with each other. These fastener are commonly known as hook and eye fasteners and are most commonly referred to by the trademark, Velcro® (used hereinafter to refer to a type of contact fasteners comprised of hook and eye elements). Clothing made with or altered to contain Velcro type fasteners are often used by the elderly or by children (particularly for shoes and sneakers) often because of their lack of physical dexterity resulting from arthritis and/or lack of coordination.

Velcro type fasteners generally comprise two complementary elements. Each of the elements has base, usually made of fabric. A series of hook elements are integrally placed on the base of one of the elements and eye elements, generally of a tufted material, are integrally placed on the base of the other of the elements. Touching contact between the hook elements and eye elements results in an instant connection, with separation requiring a lateral peeling action (to disengage the hooks from the eyes).

The use of these fasteners on clothing generally requires that the hook and eye base elements be permanently affixed to a garment or shoe, as the underlying base, such as by sewing or with a strong adhesive. This however requires clothing alteration, with permanent change of the garment. In addition laundering becomes problematic since the Velcro type fastener elements, particularly the tufted eyes, are often damaged by water and especially hot water and harsh detergents used in laundering. This may necessitate the tedious need for removal of the Velcro fastener and the subsequent reattachment, when the garments require laundering.

SUMMARY OF THE INVENTION

It is an object of the present invention to provide a quick release and fastening system, in place of a button closure, which utilizes hook and eye fastening elements (Velcro type) but which elements are not permanently affixed to a garment. As a result, garment alterations are not necessary for emplacement of the fastening elements. In addition, laundering of the garment, without damage to the fastener, is able to be effected with simple unbuttoning removal of the fastening elements.

It is a further object of the present invention to provide a garment fastening system which temporarily utilizes existing fastening elements of the garment such as buttons and buttons holes, to provide a means for the temporary anchoring of the fastening elements of the present invention to a garment.

Generally the present invention comprises a fastening system for fastening garment elements, with the garment comprising a button closure comprised of a button and a buttonhole. The fastening system is comprised of two fastening members, each of which has a base element. A base element of a first member is integrated with hook elements of a hook and eye fastener and the base element of the second member is integrated with eye elements of the hook and eye fastener. A fastener button is fixedly attached to a side of a base element of one of the two members, on a side obverse to the integrated hooks or eyes thereon. The other of the two members comprises an engaging fastener aperture, which extends through the base element and the integrated hooks or eyes thereon. The engaging fastener aperture permit the garment button to pass therethrough, effecting a holding engagement between the member and a garment element.

The fastening system is comprised for use with a garment having a button closure comprised of a button and a buttonhole. The system comprises two members, each of which comprises a base element. A base element of a first member is integrated with hook elements of a hook and eye fastener of a Velcro type and the base element of the second member is integrated with eye elements of a hook and eye fastener of a Velcro type. A button is fixedly attached, such as by being sewn thereon, to a side of a base element of one of the two members, on a side obverse to the integrated hooks or eyes. The other of the two members is provided with a slot, buttonhole, or other engaging aperture, which extends through the base element and the integrated hooks or eyes.

The button attached to one member is configured to fit within a corresponding buttonhole of a garment whereby it simulates the normal appearance of a button of the garment as passed through the buttonhole and wherein the hooks or eyes of the member to which the button is attached, is positioned to face the normally used button of the garment. The slit or buttonhole provided in the other of the members is configured to permit the button of the garment to fit therethrough, with the hooks or eyes of the member with the buttonhole, surrounding the button of the garment placed therethrough.

With such placement of the two members, "button" fastening of the garment, such as a shirt or other garments with a button fastening closure, is effected by simply touch contacting of the hooks or eyes of the member with the attached button to the hook or eyes of the member with the buttonhole. The connection between the hooks and eyes is configured to surround and enclose the button of the garment.

The attachment effected by the present fastening system simulates the appearance of a normal garment button closure but without the need for manipulation required for effecting an actual button closure. Disengagement of the ersatz button closure is simply and quickly done by peeling apart the garment segments to which the members are attached. This disengages the members of the fastening system to permit opening and removal of the garment. The button and buttonhole of the garment function as the sole anchoring elements for the two members whereby the two members of the fastening system are readily removable from the garment when the garment requires laundering.

The above and other objects, features and advantages of the present invention will become more evident from the following discussion and drawings in which:

SHORT DESCRIPTION OF THE DRAWINGS

Figure 1B:
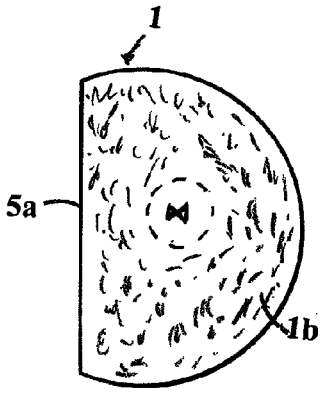
Figure 2:
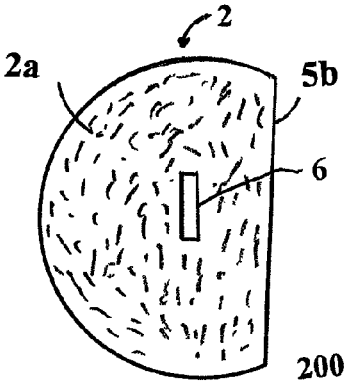
Figure 4A:
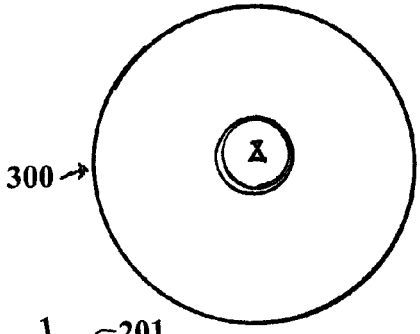
Figure 4C:
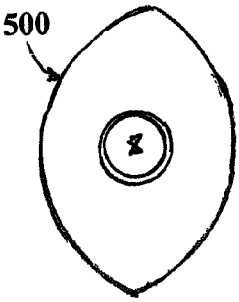
Figure 3:
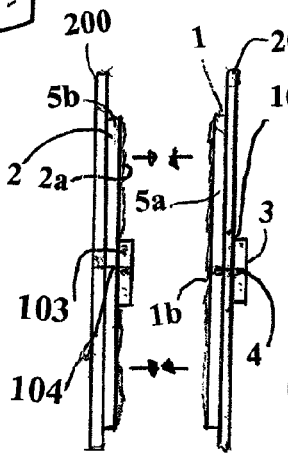
Figure 4B:
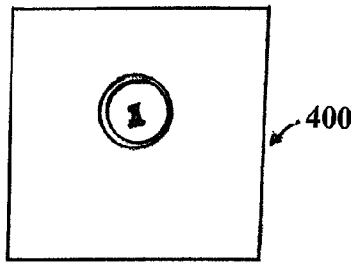

FIG. 1A is a plan view of the first member having a button attached thereto, FIG. 1B is a plan view of the obverse side of the first member shown in FIG. 1*a*, showing the integrated hook or eye elements, FIG. 2 is a plan view of the second member with the through buttonhole shown, surrounded by the integrated hook or eye elements complementary to those of the first member, FIG. 3 is a schematic separated cut-away side view of the first and second members with each attached to a garment via the existing button and buttonholes of the garment, and FIGS. 4A-C depict full circular, square and oval shapes embodiments of the first member respectively (with corresponding shape of the complementary second member) as other possible shapes of the fastening elements.

DETAILED DESCRIPTION

The member pairs of the fastening system are applied to each set of button-buttonhole of the garment, as needed or desired. It is preferred that the buttons attached to the members be the same as or similar to the buttons of the garment and that they are the same as or similar to each other, for the best simulated appearance.

It is preferred that each of the members be minimally sized and configured to prevent visible appearance extension of the fastening members beyond attached edges of the attached segments of the garment. In addition, the members should not interfere with multiple placements thereof with respect to numerous existing garment buttons and buttonholes. However, the members should be sufficiently large enough to provide adequate fastening holding between the hooks and eyes thereof to prevent unwanted opening of the garment.

FIGS. 1A and 1B show opposite sides 1*a* and 1*b* of the member 1 to which button 3 is attached by thread 4. Either hooks or eyes are integrated with side 1*b* on the side obverse to the button 3. Edge 5*a* is provided to reduce extension of the member beyond a garment edge and is configured to align with edge 5*b* of member 2, shown in FIG. 2, when the members are fastened to each other, as shown in FIG. 3. Member 2 in FIG. 2 has a surface 2*a* integrated with the complement of the hooks or eyes on the surface 1*b* of member 1. Slot buttonhole 6 extends through the entire thickness of member 2.

As shown in FIG. 3, member 2 is placed on garment segment 200 and is held thereon by means of existing garment button 103, which is in turn held on the garment by being sewn thereon with thread 104. The garment button 103 passes through buttonhole 6 and is held therein and is peripherally surrounded by exposed fastening elements 2*a*. It is understood that the placement of the hook and eyes on either of the members is interchangeable with the other in accordance with this inventions.

Garment segment 201, normally configured for button attachment with garment segment 200, anchors member 1 by means of button 3 which is inserted and held by garment buttonhole 6 with exposed fastening elements being on the side obverse to button 3. With such configuration and placement, fastening element 1*b* faces fastening element 2*a* with a simple touch connection. As shown by the arrows, movement of the members 1 and 2 effects the fastening between garment segments 200 and 201, via fastening engagement between the hooks and eyes of elements 1*b* and 2*a*, with an externally visible button 3 passing through garment buttonhole 106.

FIGS. 4*a-c* depict full circular, square and oval shape embodiments 300, 400 and 500 corresponding to the first member, respectively (with corresponding shape of the complementary second member) as other possible shapes of the fastening elements.

It is understood that the above drawings and specific example of the system elements of the present invention are only exemplary of the present invention with changes in structure, configuration, components and the like being possible without departing from the scope of the present invention as defined in the following dais.

What is claimed is:

1. A removable fastening system for fastening elements of a garment together, with the garment comprising a button closure comprised of a button and a buttonhole, the removable fastening system comprising two fastening members, each of which comprises a base element, with the base element of a first fastening member being integrated with hook elements of a hook and eye fastener type and the base element of a second fastening member being integrated with eye elements of the hook and eye fastener type, wherein a fastener button is fixedly attached to a side of a base element of one of the two members, on a side obverse to the integrated hooks or eyes thereon, wherein the fastener button is configured to pass through the buttonhole of the button closure and to be removably held therein for visual simulation of the garment button and to provide the sole removable engagement holding between the fastener button and the buttonhole for holding of the fastening member with the fastening button to the garment, and with the other of the two members comprising an engaging fastener aperture, which aperture extends through the base element and the integrated hooks or eyes thereon, and which engaging fastener aperture is configured to permit the garment button to pass therethrough and to thereby effect a removable holding engagement between the member and a garment element with only removable holding engagement between the garment button and the member with the fastener aperture and wherein the first and second members are configured and positioned to be fastened to each other via the respective hook and eye elements to effect fastening of the garment elements which simulates garment element fastening with the existing button closure.

2. The removable fastening system of claim 1, wherein the fastening members are configured to have the same shape and dimensions for co-fitting superimposability.

3. The removable fastening system of claim 2, wherein the fastening members are sized and configured to not be visible when removably attached to the garment.

4. The removable fastening system of claim 1, wherein the fastener button is positioned at an approximate center of the member to which it is affixed.

5. The removable fastening system of claim 1, wherein the fastener aperture is positioned at an approximate center of the member through which it passes.

* * * * *